US005762477A

United States Patent [19]

Jepsen et al.

[11] Patent Number: 5,762,477

[45] Date of Patent: Jun. 9, 1998

[54] PISTON/SLIDE SHOE ARRANGEMENT

[75] Inventors: Hardy Peter Jepsen; Egon Kristensen, both of Nordborg; Lars Martensen, Sønderborg, all of Denmark

[73] Assignee: Danfoss A/S, Nordborg, Denmark

[21] Appl. No.: 765,556

[22] PCT Filed: Jun. 28, 1995

[86] PCT No.: PCT/DK95/00274

§ 371 Date: Dec. 23, 1996

§ 102(e) Date: Dec. 23, 1996

[87] PCT Pub. No.: WO96/02754

PCT Pub. Date: Feb. 1, 1996

[30] Foreign Application Priority Data

Jul. 13, 1994 [DE] Germany ..... 44 24 672.2

[51] Int. Cl.[6] ..... F04B 1/20

[52] U.S. Cl. ..... 417/269; 91/499; 92/71

[58] Field of Search ..... 417/269; 74/60; 91/499; 92/57, 12.2, 71

[56] References Cited

U.S. PATENT DOCUMENTS 3,183,848 5/1965 Raymond .

3,958,901 5/1976 Drevet ..... 417/269

5,601,009 2/1997 Jepsen et al. ..... 417/269

5,685,215 11/1997 Jepsen et al. ..... 417/269

FOREIGN PATENT DOCUMENTS 2-125979 5/1990 Japan .

*Primary Examiner*—Charles G. Freay

*Attorney, Agent, or Firm*—Lee, Mann, Smith, McWilliams, Sweeney & Ohlson

[57] ABSTRACT

A piston/slide shoe arrangement of a hydraulic piston machine is disclosed having a slide shoe in connection with a piston (4), with a friction reducing plastics material there between, wherein the plastics material, forming channel, extend into a through opening in the slide shoe in a direction towards a sliding contact surface of the slide shoe. The sliding contact surface in operation lies against a swash plate. The slide shoe and the plastics material are provided outside the through-opening with at least one connecting element which takes up the shear forces between the slide shoe and the plastics material.

15 Claims, 1 Drawing Sheet

PISTON/SLIDE SHOE ARRANGEMENT

Figure 1:
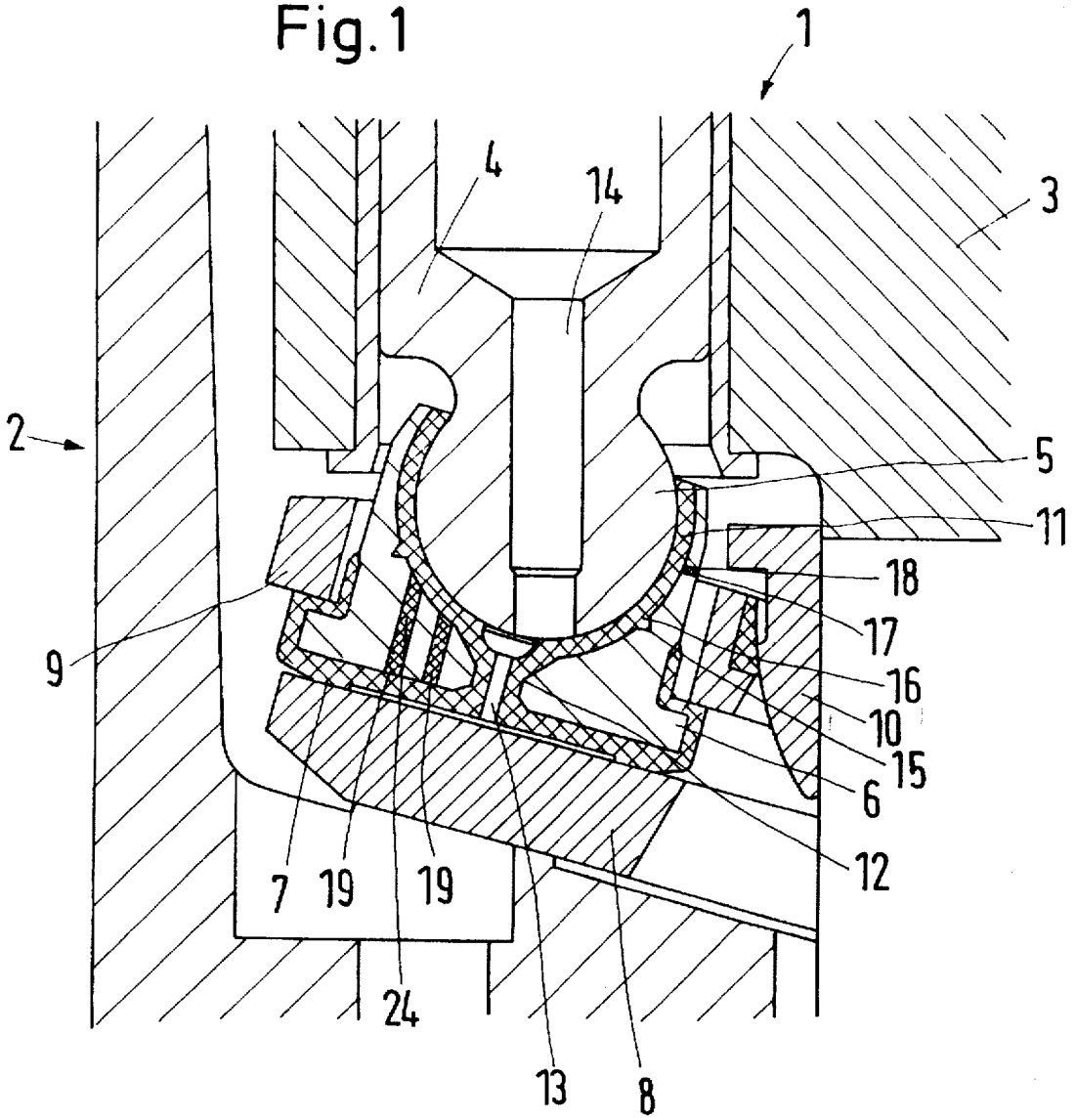

The invention relates to a piston/slide shoe arrangement of a hydraulic piston machine having a slide shoe, which is in articulated connection with a piston, with a friction-reducing plastics material therebetween, wherein the plastics material, forming a channel, extends into a through-opening in the slide shoe in a direction towards a sliding contact surface of the slide shoe which in operation lies against a swash plate.

Such an arrangement is known from the non-prior-published German patent application 43 01 123.

Normally, the piston is joined to the slide shoe by way of a ball-and-socket joint. In the case of an axial piston machine, the slide shoe lies against a swash plate so that, as a cylinder drum receiving the piston rotates with respect to the swash plate (or vice versa), a back and forth movement of the piston is produced. During this movement, the slide shoe is pivoted in relation to the piston.

In operation, friction occurs firstly between the slide shoe and the swash plate and secondly between the slide shoe and the piston. This is not critical provided that a natural or synthetic oil having satisfactory lubricating properties is used as hydraulic fluid. In that case, lubrication is ensured by this oil, so that wear and tear is kept within limits. If the hydraulic fluid does not have the required lubricating properties, however, as is the case, for example, with water as hydraulic fluid, measures must be taken not only to keep the wear and tear within limits, but actually to allow operation of the machine in the first place. Without such measures, the parts moving against one another would sooner or later wear away and permanently damage the machines.

In the prior application, the task of reducing friction is therefore assumed by the plastics material which is arranged between the piston and the slide shoe. Occasionally, however, the plastics material on the slide shoe has become displaced under adverse conditions. This displacement can even extend to the plastics material working its way out of the region between the ball-and-socket joint of the piston and the slide shoe. In that case, the piston will rub directly against the slide shoe, which will sooner or later lead to the two parts wearing each other away. Indeed, this relative movement between the piston and the slide shoe is made somewhat more difficult by that part of the plastics material which extends through the through-opening in the slide shoe in the direction towards the sliding contact surface. As this plastics material, however, has to form a channel in order to allow passage of hydraulic fluid to the sliding contact surface, and this channel widens out towards the piston to provide a reliable fluid connection to a supply channel in the piston even with an obliquely positioned slide shoe, the resulting holding force effected is sometimes insufficient to accommodate the shear forces that occur. These shear forces occur in particular when the machine is put into operation every now and then after intervals of non-use.

The invention is based on the problem of improving the piston/slide shoe arrangement in such a manner that it has a relatively long service life even under adverse operating conditions.

In an arrangement of the kind mentioned in the introduction, this problem is solved in that the slide shoe and the plastics material have outside the through-opening at least one connecting element which takes up shear forces between slide shoe and plastics material.

With a construction of that kind, on the one hand the plastics material continues to be retained as the friction-reducing element between the slide shoe and the piston. On the other hand, however, the plastics material is safeguarded against being displaced from the region between the piston and the slide shoe by shear forces, that is, forces which arise as a result of piston and slide shoe moving against one another.

The connecting element preferably surrounds an axis of the slide shoe substantially point-symmetrically, or several connecting elements are provided which are arranged substantially point-symmetrically around the axis. Despite the use of connecting elements there is no danger that the fixing forces will become unbalanced. Under adverse conditions this could again lead to overstressing of individual parts of the plastics material and thus to degradation or displacement of the same.

The connecting element is preferably formed in one piece with the plastics material or with the slide shoe. No additional parts are therefore required. On the contrary, it is enough to re-shape the existing parts in order to produce the connecting elements. Re-shaping is here kept within relatively narrow limits.

In a preferred construction, provision is made for the slide shoe to have on its face against which the plastics material lies at least one recess in which the connecting element engages. For that purpose, before the plastics material is applied, the slide shoe merely has to be machined, namely on that face against which the plastics material lies. Such machining is in many cases relatively easy to carry out. If the slide shoe is a cast part, the recess can be made during the casting process. For the rest, such a recess can be produced by the usual metal-removing types of shaping, such as drilling, milling, turning etc.

For example, the recess can be in the form of a groove that is circumferential at least in sections. In that case, the groove can be made by turning. It can also be produced using a drill having an appropriately large diameter; in that case the drill bit cutting edges should be effective only at the outside.

It is here especially preferable for the groove to be of substantially V-shaped form. In that case, there is one flank of the groove which is at least substantially parallel to the sliding contact surface, while the other flank is arranged substantially at right-angles thereto. The angular range can vary here within relatively wide limits, of course. Nevertheless, taking-up of forces is always provided in both directions. Shear forces are consequently reliably taken up in all directions.

In this case, the groove preferably lies in the region of the middle of an arcuate portion between the axis and the end of the slide shoe. Forces arising are taken up in such a way that substantially all parts of the plastics material are uniformly stressed. If several grooves are provided, it is sensible to arrange these at uniform intervals apart so that again all parts of the plastics material are uniformly stressed.

In another preferred construction, the recess is in the form of a bore. In this case, the connecting elements are of bolt-shaped construction and project into the bore. Here also, shear forces can be taken up with great reliability. This is particularly so when at least one or some of the bores are arranged substantially parallel to the sliding contact surface of the slide shoe, although this is not a necessary requirement.

It is here especially preferred for the bore to be in the form of a through-bore, and for a region of the slide shoe to be covered with the friction-reducing plastics material at also the outlet of the bore from the slide shoe, and for the friction-reducing plastics material to be taken as connecting element through the bore. The connecting element is here in the form of a rivet, that is to say, it not only fixes the plastics material in the slide shoe against lateral displacement, such as could be caused by shear forces, but also holds the plastics material fixedly against the body of the slide shoe. This is of particular advantage during manufacture. Under adverse conditions small air bubbles may become trapped between the plastics material and the slide shoe as the plastics material is being applied. During finishing, during which the pressures that act on the plastics material are not particularly high, this then leads to the creation of a shape that is different from that in later use in operation. The finished state is then no longer consistent with the operational state, which can have adverse consequences in operation, in particular leaks.

The through-bore preferably ends at the sliding contact surface. The connecting element then connects the friction-reducing plastics material between the piston and the slide shoe with a layer of the friction-reducing plastics material which is arranged on the sliding contact surface. These are the two areas that suffer greatest stress.

It is especially preferred herein for the diameter of the bore to be at least as great as the thickness of the plastics material. Especially when the plastics material is cast and contracts or shrinks as it hardens, a greater shrinkage of the plastics material forming the connecting element is achieved in the bore by this dimensional rule, so that the plastics material at the two surfaces surrounding the bore is drawn by the connecting element itself very tightly against the slide shoe. Relatively high strength is achieved by this means.

In an alternative construction, the connecting element is preferably in the form of a flanged-over edge of the slide shoe which acts on the end-face edge of the plastics material. In that case, the plastics material is held only at its edge, but it is unable to escape at any point so that it is held with the necessary reliability in its desired position. The term "flanging-over" is not restricted to the manufacturing process. Such an edge can be made by methods other than flanging-over.

As a further alternative, in an advantageous construction the connecting element is in the form of a spring which sits in grooves in the plastics material and the slide shoe. In that case, the connecting element is a separate part. Such a groove-and-spring connection is preferred, for example, when the material of the plastics material or of the slide shoe is not adequate for provision of a connecting element of the required strength.

In all cases it is an advantage for the plastics material to be in the form of an injection-moulded part. It can then be injected in situ and can form on the one hand the necessary connections between the plastics material and the slide shoe and on the other hand can create the desired sliding contact surface facing towards the piston.

Figure 2:
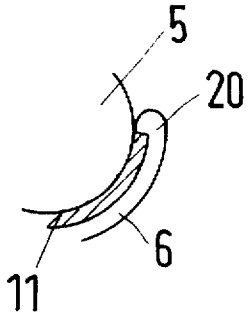
Figure 3:
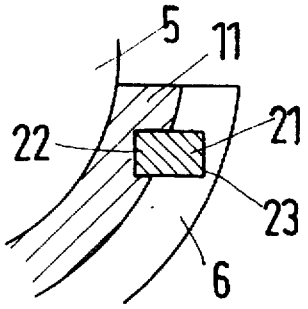

The invention is described hereinafter with reference to preferred embodiments in conjunction with the drawings, in which FIG. 1 is a diagrammatic view of a piston/slide shoe arrangement, FIG. 2 shows a first alternative method of fixing the plastics material and FIG. 3 shows a second alternative method of fixing the plastics material to the slide shoe.

The following embodiments relate to an axial piston machine 1, part of which with its piston/slide shoe arrangement 2 is shown in FIG. 1. Such a piston/slide shoe arrangement can also be used in other machines, however, for example, a radial piston machine.

The axial piston machine 1 has a cylinder drum 3 in which several pistons 4, of which one is illustrated, are movable back and forth. Each piston is provided at the end that can be extended out of the cylinder drum 3 with a spherical head 5. A slide shoe 6 is arranged, articulated, on this spherical head. The slide shoe lies with a sliding contact surface 7 against a swash plate 8. The swash plate 8 has a predetermined or adjustable inclination in relation to the axis of rotation of the cylinder drum 3. The slide shoe 6 is held in contact with the swash plate 8 by a pressure plate 9. To that end, the pressure plate 9 is biassed by a spherical member 10.

On rotation of the cylinder drum 3 with respect to the swash plate 8, the slide shoe 6 is pivoted once back and forth with respect to the spherical head of the piston 4. A relative movement consequently occurs between the spherical head 5 and the slide shoe 6, accompanied by the friction caused thereby.

To reduce the wear and tear caused by the friction, a plastics material part 11 is arranged between the spherical head 5 and the slide shoe 6. This plastics material part 11, which basically need be present only in the form of a thin layer (the drawing shows an exaggeratedly large thickness for reasons of clarity), covers the region between the slide shoe 6 and the spherical head 5. It thus prevents contact between the slide shoe 6 and the spherical head 5. The slide shoe 6 is provided with a through-opening 12 which extends as far as the sliding contact surface 7. The plastics material 11 is taken through the through-opening 12 and onto the sliding contact surface 7. It forms a channel 13 which flares towards the spherical head 5 in order to ensure that there is a fluid connection to a fluid channel 14 formed in the piston 4 even when the slide shoe 6 is inclined. The fluid passed through the channel 14 then reaches the region between the sliding contact surface 7 of the slide shoe 6 and the swash plate 8. There, it has on the one hand a certain cooling effect, and also on the other hand effects hydrostatic relief.

The plastics material 11 is continued externally around the slide shoe 6 and is taken upwards so that it also reduces friction between the pressure plate 9 and the slide shoe 6.

During movement between the slide shoe 6 and the spherical head 5, forces act on the plastics material layer and attempt to displace the plastics material 11 with respect to the slide shoe 6. In adverse circumstances, this can even lead to the plastics material's (11) being pushed out of the gap between the slide shoe 6 and the spherical head 5. The part of the plastics material surrounding the channel 13 is taken through the slide shoe 6, but does not always have the necessary powers of resistance. This is probably attributable inter alia to the flaring of the channel 13 at the end facing towards the spherical head 5. The plastics material 11 can fold in and break here.

For that reason, away from the centre there are provided connecting elements which can be constructed in different ways. At least one further connecting element is therefore provided which is placed further towards the outside and for that reason is also able to accommodate a relatively large moment on the layer when the slide shoe moves against the piston.

Firstly, a V-shaped groove 15 is provided in the slide shoe 6 in the sliding contact surface lying opposite the spherical head. The form of this groove can be circumferential. Alternatively, it may extend only over sections of the circumferential direction. A projection formed in the plastics material 11 projects into this groove 15. This projection 16 is formed in one piece with the plastics material 11. In operation, when the spherical head 5 presses the plastics material 11 against the slide shoe 6, the projection 16 prevents a lateral movement of the plastics material relative to the slide shoe 6. In another alternative, a bore 17 can be made in the sliding contact surface of the slide shoe. This bore can likewise be filled with a part 18 of the plastics material which is joined in one piece to the plastics material 11. The part 18 thus forms a bolt which is also able to take up shear forces between the plastics material part and the slide shoe 6.

As a third alternative, bores 19 can be provided; these are in the form of through-bores and connect the region between the spherical head 5 and the slide shoe 6 with the sliding contact surface 7. The plastics material 24 arranged in the through-bores 19 is thus able to interconnect, as would a rivet, the plastics material in the region between the spherical head 5 and the slide shoe 6 and in the region between the slide shoe 6 and the swash plate 8. When the bores have a diameter that is larger than the thickness of the plastics material layer 11, and if the plastics material 11 is in the form of an injection-moulded part, as the plastics material hardens one can observe shrinkage that it so great that the plastics material is drawn very tightly against the slide shoe. This too leads to improved adhesion of the plastics material 11 to the slide shoe 6. Injection moulding of the plastics material 11 has the particular advantage that, in the embodiment illustrated, all possible fixing options, that is, all connecting elements, can be constructed in one piece with the plastics material 11. During the injection-moulding, the plastics material is forced into the grooves 16 or bores 17, 19 that are provided. Virtually no further measures are required.

FIG. 2 shows a further alternative, in which the plastics material 11 is fixedly held by a flanged-over edge 20 of the slide shoe 6. The flanged-over edge 20 here acts only on the end-face edge of the plastics material 11. This is sufficient, however, to hold the plastics material 11 reliably against the slide shoe 6. The flanged-over edge 20 extends very close to the spherical head 5, but does not touch it.

FIG. 3 shows a further alternative, in which a spring 21, that is, an additional part, is inserted in a groove 22 in the plastics material part 11 and a groove 23 in the slide shoe 6. Such a spring 21 can be adopted, for example, when the material of the plastics material 11 or of the slide shoe 6 does not have the necessary strength to form a connecting element strong enough to withstand the shear forces that occur.

In all cases, it is advantageous if the connecting elements are arranged so that they surround the bore and the channel 13 symmetrically. This can be achieved on the one hand in that the connecting elements are circumferential, and on the other hand also by providing the connecting elements at equal angular spacings in the circumferential direction. In each case, even when using the flanged-over edge 20 or the spring 21, the plastics material 11 can be in the form of an injection-moulded part which does not need to be moulded until the slide shoe 6 has been mounted together with the spherical head 5.

The "friction-reducing" property of the plastics material is always with respect, of course, to the material along which the plastics material slides, in this particular case the material of the spherical head 5 of the piston 4. If this spherical head 5 is made of metal, suitable plastics materials for the plastics material part 11 are in particular materials from the group of high-strength thermoplastic plastics materials based on polyarylether ketones, in particular polyether ether ketones, polyamides, polyacetals, polyaryl ethers, polyethylene terephthalates, polyphenylene sulphides, polysulphones, polyether sulphones, polyether imides, polyamideimide, polyacrylates, phenol resins, such as novolak resins, or similar substances; glass, graphite, polytetrafluoroethylene or carbon, especially in fibre form, can be used as fillers. When using such materials, it is possible to use even water as hydraulic fluid.

We claim:

1. A piston/slide shoe arrangement for a hydraulic piston machine having a slide shoe which is in articulated connection with a piston, and having a friction-reducing plastics material between the slide shoe and the piston, the plastics material, in the form of a channel, extending into a through-opening in the slide shoe in a direction toward a sliding contact surface of the slide shoe, the slide shoe in operation lying against a swash plate, the slide shoe and the plastics material outside the through-opening having at least one connecting element which bears shear forces between the slide shoe and plastics material.

2. An arrangement according to claim 1, in which the connecting element surrounds an axis of the slide shoe substantially point-symmetrically.

3. An arrangement according to claim 2 including the plurality of connecting elements arranged substantially point-symmetrically around the axis.

4. An arrangement according to claim 1, in which the connecting element is formed in one piece with one of the plastics material and the slide shoe.

5. An arrangement according to claim 1, in which on a face against which the plastics material lies, the slide shoe has at least one recess in which the connecting element is engaged.

6. An arrangement according to claim 5, in which the recess comprises a groove that is circumferential at least in sections.

7. An arrangement according to claim 6, in which the groove is of substantially V-shaped form.

8. An arrangement according to claim 6, in which the groove extends in a region of the middle of an arcuate portion between an axis of the slide shoe and an end of the slide shoe.

9. An arrangement according to claim 5, in which the recess comprises a bore.

10. An arrangement according to claim 9, in which the bore comprises a throughbore, and a region of the slide shoe is covered with the friction-reducing plastics material at an outlet side of the bore, the friction-reducing plastics material extending as the connecting element through the bore.

11. An arrangement according to claim 10, in which the through-bore ends at the sliding contact surface.

12. An arrangement according to claim 10, in which the bore has a diameter at least as great as the thickness of the plastics material.

13. An arrangement according to claim 1, in which the connecting element comprises a flanged-over edge of the slide shoe which acts on an end-face edge of the plastics material.

14. An arrangement according to claim 1, in which the connecting element comprises a spring which sits in grooves in the plastics material and the slide shoe.

15. An arrangement according to claim 1, in which the plastics material is injection-moulded.

* * * * *